US007024979B1

(12) United States Patent
Lundin

(10) Patent No.: US 7,024,979 B1
(45) Date of Patent: Apr. 11, 2006

(54) CUTTING TEMPLATE FOR CUTTING MEAT PIECES

(76) Inventor: Zachary A. Lundin, 12537 Preston Way, Los Angeles, CA (US) 90066

( * ) Notice: Subject to any disclaimer, the term of this patent is extended or adjusted under 35 U.S.C. 154(b) by 52 days.

(21) Appl. No.: 10/613,134

(22) Filed: Jul. 3, 2003

(51) Int. Cl.
*B26B 3/00* (2006.01)

(52) U.S. Cl. ..... 83/743; 30/124; D7/672; D7/673

(58) Field of Classification Search ..... D7/669, D7/672–673, 684–687, 692; 83/743; 30/124–125, 30/136, 358, 308, 322, 340–344; 269/54.3, 269/218, 315, 87.1; 248/37.3, 684
See application file for complete search history.

(56) References Cited

U.S. PATENT DOCUMENTS

| | | | | | |
|---|---|---|---|---|---|
| 935,197 | A | * | 9/1909 | Feller | 83/743 |
| 1,761,104 | A | * | 6/1930 | Cutler | 269/53 |
| 1,871,713 | A | * | 8/1932 | Lowenthal | 269/54.3 |
| 2,007,237 | A | * | 7/1935 | Adams | 30/322 |
| 2,048,999 | A | * | 7/1936 | Dailey | 269/54.1 |
| 2,057,250 | A | | 10/1936 | Sanger | |
| 2,364,250 | A | * | 12/1944 | Stokes | 452/132 |
| D149,961 | S | * | 6/1948 | Mason | D7/683 |
| 2,655,191 | A | * | 10/1953 | Partin | 269/54.4 |
| D170,912 | S | | 11/1953 | Collins et al. | |
| 2,665,649 | A | | 1/1954 | Cesare | |
| D179,131 | S | | 11/1956 | Frey | |
| 2,791,029 | A | * | 5/1957 | Henneberger | 30/305 |
| 2,925,110 | A | | 2/1960 | Bayers | |
| 2,943,883 | A | * | 7/1960 | Hansen | 194/49 |
| 3,052,439 | A | * | 9/1962 | Marx | 248/117.2 |
| 3,074,449 | A | * | 1/1963 | Mikulas | 30/120.2 |
| 3,153,810 | A | * | 10/1964 | Adams | 249/117 |
| 3,191,648 | A | * | 6/1965 | Dustrude | 30/506 |
| 3,199,560 | A | * | 8/1965 | O'Donovan | 269/1 |
| D203,612 | S | | 2/1966 | Walter, Jr. | |
| D203,762 | S | | 2/1966 | Dayton | |
| 3,319,682 | A | * | 5/1967 | Hall | 269/288 |
| 3,456,346 | A | | 7/1969 | Snyder | |
| 3,556,507 | A | * | 1/1971 | Haskell | 269/98 |
| 3,946,461 | A | | 3/1976 | Martin | |
| D258,634 | S | * | 3/1981 | Adams | D7/683 |
| D260,841 | S | | 9/1981 | Gilmore | |
| 4,941,379 | A | | 7/1990 | Gasbarro | |
| D350,882 | S | | 9/1994 | Charland | |
| 5,370,573 | A | | 12/1994 | Warren et al. | |
| 5,569,070 | A | | 10/1996 | Smith | |
| 5,573,216 | A | * | 11/1996 | Kuroda | 248/316.7 |
| 6,090,204 | A | * | 7/2000 | Speed et al. | 118/500 |
| 6,383,068 | B1 | | 5/2002 | Tollett et al. | |
| D487,002 | S | * | 2/2004 | Sarihan | D7/673 |
| 2004/0255975 | A1 | * | 12/2004 | Stiles | 134/6 |

* cited by examiner

*Primary Examiner*—Allan N. Shoap
*Assistant Examiner*—Carolyn Blake
(74) *Attorney, Agent, or Firm*—Jack C. Munro

(57) ABSTRACT

A cutting template for use for cutting of a plurality of substantially equal size meat pieces. The cutting template is to be hand operated by being placed by the user in conjunction with a meat section and then the user takes the knife and severs the meat section that is defined in size by the template.

5 Claims, 2 Drawing Sheets

CUTTING TEMPLATE FOR CUTTING MEAT PIECES

BACKGROUND OF THE INVENTION

1. Field of the Invention

The field of this invention relates to templates to be used in producing pieces of meat of substantially all of the same size and weight.

2. Description of the Related Art

A common foodstuff that is currently being distributed within restaurants is an appetizer or a dinner which includes chicken strips. Chicken strips are strips of chicken breast meat. The restaurant is able to purchase a forty pound box of chicken strips from a food distributor. Within this forty pound box there is to be a precise number of chicken strips, approximately three hundred and twenty-eight in number. Currently, chicken strips are being produced by the distributor having employees approximate the size of the chicken strip and to cut that size from the chicken breast. This approximation results in not a precise number of chicken strips being produced within a forty pound box.

A restaurant selling chicken strips receives compensation for a precise number of chicken strips within the meal or appetizer. In other words, the restaurant would typically serve eight in number of chicken strips in an appetizer. If there are three hundred and twenty-eight chicken strips in a forty pound box, but because of the inaccurate slicing of the chicken strips by the distributor, there are only two hundred and ninety-six, the restaurant instead of being able to sell forty-one appetizer meals out of a forty pound box is only able to sell thirty-seven. That means that the restaurant, in essence, is losing four sales. This is not a financially desirable practice as far as the restaurant is concerned.

In an effort to overcome this problem, there has been in the past attempts to manufacture machines that precisely replicate chicken strips and produce chicken strips of a precise size and weight. However, these machines are expensive and cost hundreds of thousands of dollars. Instead of an expensive machine, what is actually needed by the distributor is a hand-held tool that can be used by employees to manually produce chicken strips repeatedly of a substantially precise size and weight. Although the subject matter of this invention is designed principally to be used in conjunction in producing of chicken strips, it is considered to be within the scope of this invention that it could be used in conjunction with any type of meat to produce a plurality of meat pieces all of the same size and weight.

SUMMARY OF THE INVENTION

A cutting template to be used for cutting a plurality of meat pieces all of which are precisely similar in size and weight. The cutting template comprises a graspable handle and a guide plate which is attached to this handle. The guide plate is elongated and extends transversely from the graspable handle. A first guide bar is attached to the template and extends outwardly from the guide plate. The guide plate is to be used by being placed against an edge of a meat section with the guide bar resting on an upper surface of the meat section with the operator to then move a cutting instrument around an exterior edge of the guide bar to cause severing of a meat piece.

A further embodiment of the present invention is where the basic embodiment is modified by there being included in conjunction with the guide bar a means for fixing the position of the guide bar with this means being mounted on the guide bar.

A further embodiment of the present invention is where the just previous embodiment is modified by the means to fix the position of the guide bar impales the meat.

A further embodiment of the present invention is where the just previous embodiment is modified by the means to fix the position of the guide bar being defined as a row of sharply pointed sawteeth.

A further embodiment of the present invention is where the basic embodiment is modified by the guide bar defining an open space between the first guide bar and the guide plate.

A further embodiment of the present invention is where the basic embodiment is modified by the cutting template including a second guide bar.

A further embodiment of the present invention is where the just previous embodiment is modified by the second guide bar being attached to the first guide bar by a cutting instrument guide.

A further embodiment of the present invention is where the just previous embodiment is modified by the including of a means for fixing the position of both the first guide bar and the second guide bar in conjunction with a piece of meat.

A further embodiment of the present invention is where the just previous embodiment is modified by defining the means for fixing of the guide bar as including structure to impale the meat.

A further embodiment of the present invention is where the just previous embodiment is modified by defining of the means for fixing the position of the guide bar as a row of sharply pointed sawteeth.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

The design of the tool provides for the cutting of individual pieces/portions of breast commonly called 'Strips' that are comparable in appearance and shape to naturally occurring tenders, found under each whole breast of a natural chicken, along each side of the breast keel. The tool has been designed to provide a means to produce nearly identically matching single portion strips of chicken breast, matching the shape of the natural tender, with the least amount of breast trim, called "by-product", and the fewest numbers of cutting strokes per strip. Ideally, a person trained to use this tool correctly can indeed produce nearly identical chicken strips in an efficient and easily repeatable fashion, with just one cutting stroke per strip. A single person using this tool can produce up to one thousand pounds of breast strips in a regular eight hour work shift with minimal waste/by-product.

The tool has been designed with certain specifications in mind that meet or exceed the customers' sizing needs. The tool can be built to produce breast strips of different weights and sizes, according to the customers' requirements. This tool has been built to produce a tender shaped breast strip, that will weigh on average forty grams, plus or minus two grams, and measure five inches in overall length, plus or minus one-half inch, and one and one-half inches in width, plus or minus one-quarter of an inch, and match the overall shape characteristics of a naturally occurring chicken tender. A natural breast tender has the appearance of an elongated teardrop, with one larger rounded end, tapering down to a smaller narrower point at an opposite other end.

Figure 1:
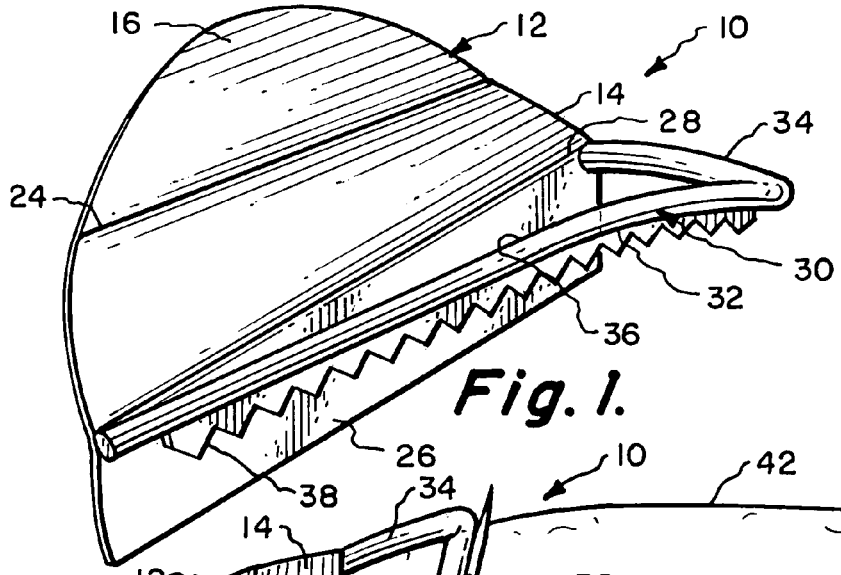
FIG. 1 is a frontal isometric view of the first embodiment of cutting template of the present invention designed to be used by a right handed operator.
Figure 2:
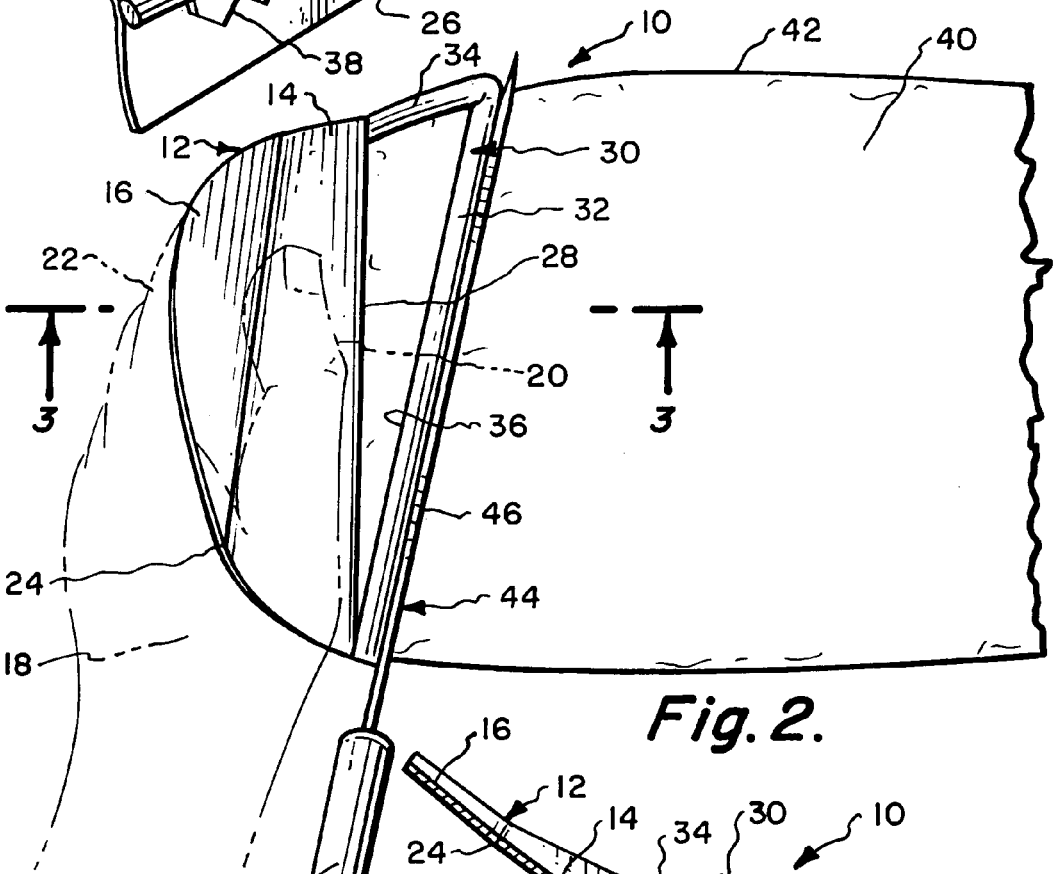
FIG. 2 is a top plan view of the first embodiment of cutting template of the present invention showing such being placed in conjunction with a meat section.
Figure 3:
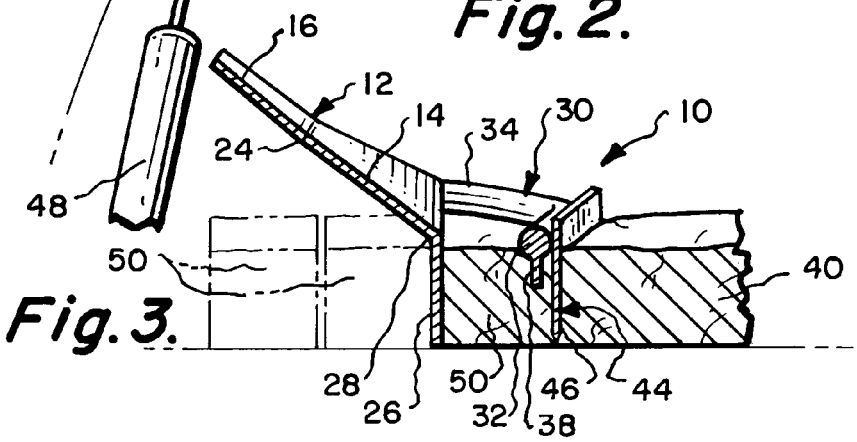
FIG. 3 is a cross-sectional view taken along line 3—3 of FIG. 2 and also depicting, in phantom, the removal of meat pieces.

Referring particularly to FIGS. 1–3, there is shown the first embodiment 10 of cutting template of this invention. The first embodiment 10 comprises a rigid, thin, metallic plate which is defined as a graspable handle 12. The graspable handle 12 includes a thumb rest section 14 and a forefinger abutting section 16. When using of the first embodiment 10 of this invention, the user or operator is to place the graspable handle 12 in conjunction with the user's left hand 18, as shown in FIG. 2 of the drawings. The user's thumb 20 is to rest on the upper surface of the thumb rest section 14. The user's forefinger 22 is to be located against the undersurface of the forefinger abutting section 16. The forefinger abutting section 16 is defined as being planar, as is also the thumb rest section 14. The forefinger abutting section 16 is deflected at a about a ten to fifteen degree angle relative to the thumb rest section 14 forming a crease 24. The thumb rest section 14 is integrally connected to a guide plate 26 at an elongated linear bend 28. The guide plate 26 is planar and is located at about one hundred fifteen to one hundred twenty degree angle relative to the thumb rest section 14. The crease 24 is not parallel to the bend 28 but is angularly disposed and about fifteen degrees away from being parallel from the bend 28. This particular angular relationship for the crease 24 seems to be best suited for manual grasping of the graspable handle 12 by the operator.

Attached directly adjacent the bend 28 on the guide plate 26 is a first guide bar 30. The first guide bar 30 is formed of a cylindrically shaped rod no more than one quarter of an inch in diameter. The thickness of the graspable handle 12 will generally be no more than one sixteenth of an inch. The first guide bar 30 is composed of an elongated curved section 32 and a short end section 34. The elongated curved section 32 is directly attached at one end of the guide plate 26 with the opposite end of the elongated curved section 32 being attached to an outer end of the end section 34. In essence, there is a space 36 enclosed by the first guide bar 30 and the guide plate 26 with this space being generally triangular in configuration. The portion of elongated section 32 that is located directly adjacent the end section 34 curves in a downward direction. The reason for this downward direction will be explained further on in the specification.

Fixedly secured to the undersurface of the elongated section 32 are a series of sharp sawteeth 38. The sawteeth 38 are to function to fix in position the first embodiment 10 in conjunction with a meat section 40 during usage. Usage of the first embodiment 10 is accomplished by placing the guide plate 26 against an edge of the meat section 40. The end section 34 is aligned with an upper edge 42 of the meat section 40. Typically, the meat section 40 will be a chicken breast which will normally have been pounded to a flat configuration so that all the chicken breasts will have substantially the same thickness. With the guide plate 26 abutting against an edge of the meat section 40, the user then takes a cutting instrument in the form of a knife 44 which has a blade 46 and a handle 48, and moves the blade 46 along the outer surface of the elongated section 32 through the meat section 40 severing the meat section 40 producing a meat piece 50.

Referring particularly to FIG. 3, there is shown two in number of meat pieces 50 which have been severed from the meat section 40. In actuality, these meat pieces 50, once severed, will be separated from the meat section 40 so that access can be obtained by placing of the guide plate 26 directly against an edge of the meat section 40, as is also shown in FIG. 3. It can thus be seen that by continually repositioning of the first embodiment 10 of this invention in conjunction with the meat section 40, that a plurality, generally four to six in number, of meat pieces 50 can be obtained from a single chicken breast.

It is also to be considered to be within the scope of this invention that the first embodiment 10 could be utilized with other types of meats, such as fish, beef, lamb, venison and the like. The meat pieces 50 will all be of the same thickness, the same configuration and should be very close in weight. Therefore, when a distributor places the meat pieces 50 within a shipping box that there should be substantially three hundred sixty such pieces within a forty pound box, and that is true of substantially every forty pound box. This means that the restaurant knows that it is able to get precisely sixty servings of the meat pieces 50 out of every forty pound box.

Figure 4:
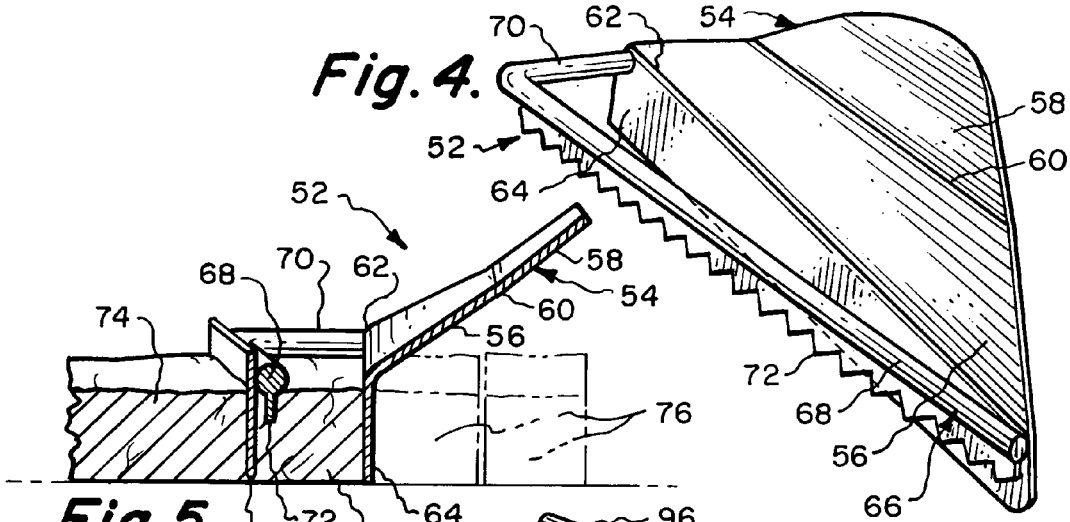
FIG. 4 is a frontal isometric view of a second embodiment of cutting template that is designed to be used by a left handed person with the cutting template to be held in the user's right hand.
Figure 5:
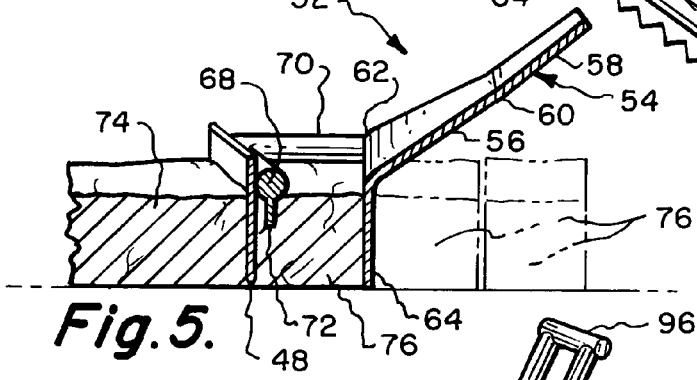
FIG. 5 is a cross-sectional view similar to FIG. 3 depicting usage of the second embodiment of cutting template of this invention in conjunction with a section of meat again depicting in phantom lines the removal of meat pieces.

The first embodiment 10 is intended to be used for a right handed person with the first embodiment 10 being held in the person's left hand and the person manipulates the knife 44 in the person's right hand to sever the meat pieces 50. Within the second embodiment 52, shown in FIGS. 4 and 5 of cutting template of this invention, there is shown a cutting template 52 that is designed to be used in conjunction with a left handed person. Basically, the second embodiment 52 is a mirror image configuration of the first embodiment 10. The second embodiment 52 includes a graspable handle 54 which is constructed again of a rigid, thin, metallic plate. The graspable handle 54 includes a planar thumb rest section 56 which is integrally connected to a forefinger abutting section 58. The forefinger abutting section 58 is connected to the thumb rest section 56 at a crease 60. The thumb rest section 56 is connected at a bend 62 to a guide plate 64. The guide plate 64 is attached at about one hundred fifteen to one hundred twenty degree angle relative to the thumb rest section 56. A first guide bar 66, which is formed of an elongated section 68 and end section 70, is welded or otherwise fixedly secured to the guide plate 64. Fixedly mounted on the undersurface of the elongated section 68 is a series of sharp pointed sawteeth 72. It is to be noted that the sawteeth 72 are in a linear pattern wherein the first embodiment 10, as previously mentioned, the fore end of the elongated section 32 is curved in a downward direction. The reason for the downward direction in the first embodiment 10 is that it facilitates the digging in or securement of the sawteeth 38 into the meat section 40. However, such a curving of the elongated section 32 may not be required, as is shown in the second embodiment 52 of this invention. Usage of the second embodiment 52 is accomplished by the guide plate 64 being placed against an edge of the meat section 74 and then a meat piece 76 is then removed from the meat section 74 by movement of the knife blade 78 along the outside surface of the elongated section 68.

Figure 6:
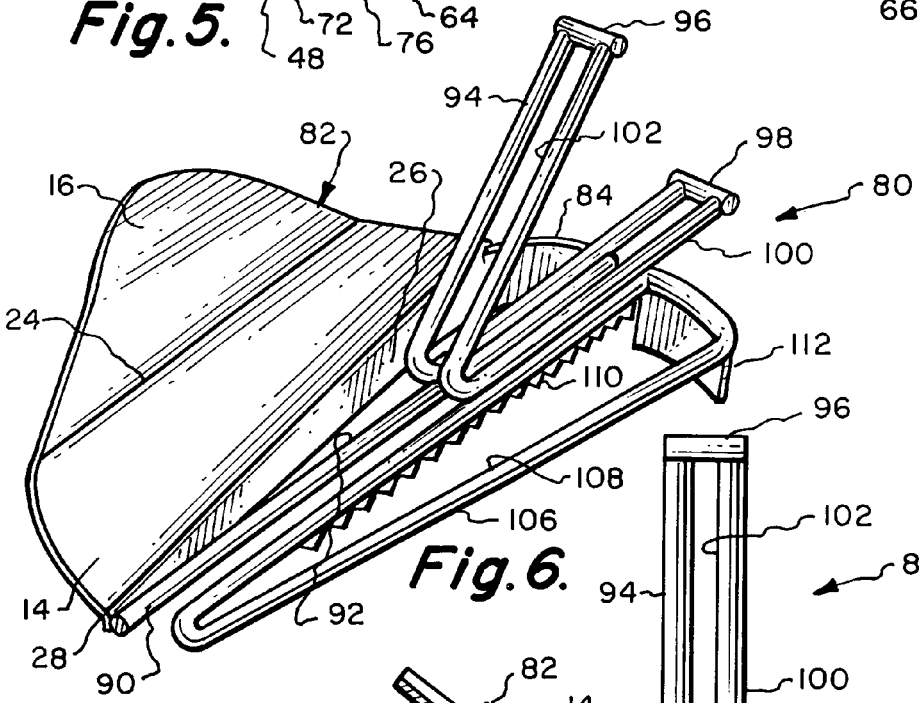
FIG. 6 is a frontal isometric view of a third embodiment of cutting template designed to be used by a right handed person by being mounted within the person's left hand where the template is able to produce two in number of meat pieces at the same time.
Figure 7:
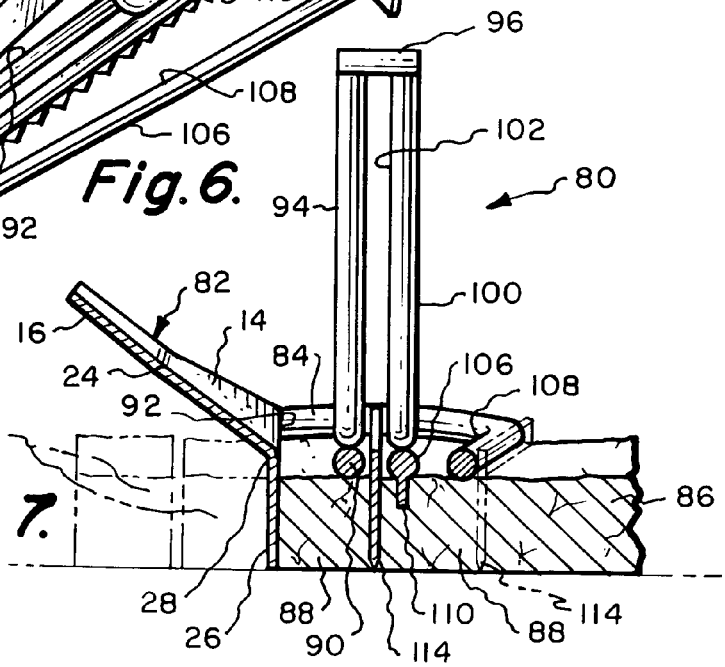
FIG. 7 is a transverse cross-sectional view through the third embodiment of FIG. 6 showing its placement and usage in conjunction with a meat section and also depicting by phantom lines the removal of meat pieces.

Referring particularly to FIGS. 6 and 7 of the drawings, there is shown a third embodiment 80 of cutting template of this invention. The third embodiment 80 is designed to be used by a right handed person and therefore the graspable handle 82 is to be held within the person's left hand. The graspable handle 82 is basically identical to the graspable handle 12 and like numbers have been utilized to refer to like parts. The exception is that the guide plate 26 is attached at its upper end to an end plate 84. The end plate 84 is to be placed against the upper edge 42 of the meat section 86 with the guide plate 26 being placed against an edge of the meat section 86 in order to produce meat pieces 88.

Attached to the guide plate 26, as by welding, is a first guide bar 90. The guide bar 90 is essentially a straight section of rod and is attached by welding to the outer end of the end plate 84. Thus, the first guide bar 90 in conjunction with the inner surface of the end plate 84 and the inner surface of the guide plate 26 encloses a space 92. It is the space 92 that determines the shape and size of the meat piece 88.

Fixedly mounted onto the upper surface of the first guide bar 90 is a U-shaped rod 94. The U-shaped rod 94 is mounted only on a portion of the first guide bar 90 that is located directly adjacent the end section of the end plate 84. At each end of the U-shaped rod 94 there is fixedly mounted, as by welding, end rods 96 and 98. A second U-shaped rod 100, identical in shape and size to rod 94, is mounted in juxtaposition to the rod 94 with the outer ends of the U-shaped rod 100 also being fixedly secured to the end rods 96 and 98. The U-shaped rods 94 and 100 form a gap area 102 therebetween. The U-shaped rod 100 is then welded or otherwise fixedly secured to a second guide bar 106. The second guide bar 106 is totally enclosing and again defines a triangularly shaped space 108. This space 108 is again to form a precisely essentially similar sized or identically sized meat piece 88 that is similar to what is obtained by the space 92. Fixedly mounted on the second guide bar 106 is a row of sawteeth 110. Fixedly mounted at the upper end of the second guide bar 106 is an end plate 112, which is similar in configuration and size to end plate 84.

When using of the third embodiment 80 of cutting template of this invention, the graspable handle 82 is held in the operator's left hand. The guide plate 26 is placed against an edge of the meat section 86 with end plates 84 and 112 placed against the upper edge of the meat section 86, which is similar to the upper edge 42. The U-shaped rods 94 and 100 function as a knife guide with a knife blade 114 to be placed within the gap area 102, and by moving of the knife blade 114 along the first guide bar 100 causes severing of a meat piece 88. Also, the knife blade can then moved alongside the outer edge of the second guide bar 106, as is shown in dotted lines in FIG. 7. This will result in the producing of a second meat piece 88. It can thus be seen that by using of the third embodiment 80 of this invention that two meat pieces are obtained at a time where using of the first and second embodiments of this invention only a single meat piece is obtained.

It is considered to be within the scope of this invention that a further embodiment of cutting template could be manufactured which could actually produce three, four or five meat pieces in a single placement in conjunction with the meat section. It is to be understood that in the third embodiment 80 of this invention that the sawteeth 110 are also to function to dig into the meat section 86 in order to fix the third embodiment 80 in position when making of the cuts with the knife blade 114.

What is claimed is:

1. A cutting template to be used for cutting a plurality of meat pieces from a meat section all of which are precisely similar in size and weight, said cutting template comprising:

a graspable handle composed of a planar forefinger abutting section and a planar thumb rest section which are separated by a crease, said forefinger abutting section being deflected at said crease at an angle to said thumb rest section;

a flat guide plate integrally attached to said thumb rest section at an elongated linear bend which is at a side of said thumb rest section opposite of said crease and extending in the same general direction as said crease, said crease being angularly disposed from parallel relative to said elongated linear bend approximately fifteen degrees, said guide plate being elongated and extending transversely from said thumb rest section;

a first corner and a second corner defined on opposite edges of the elongated linear bend;

a guide bar comprising an elongated first leg and a shorter second leg;

the first leg comprising a first end, a second end, and means for penetrating meat there between;

the second leg comprising a first end and a second end; and wherein the first end of the first leg is directly connected to the first corner, the first end of the second leg is directly connected to the second corner, and second ends of both legs are directly connected to one another at an acute angle;

whereby said guide plate is to be placed against an edge of the meat section with said guide bar resting on an upper surface of the meat section with the operator to then move a separate cutting instrument around an exterior edge of said guide bar to cause severing of a first said meat piece with the procedure to then be repeated to obtain other said meat pieces.

2. The cutting template as defined in claim 1 wherein:

said means comprising a row of sharply pointed sawteeth mounted on said guide bar.

3. The cutting template as defined in claim 1 wherein:

said guide bar encloses an open space which is closed at one side by said guide plate and closed at the opposite side by said guide bar, during severing of the meat piece the meat piece is to be located directly adjacent said open space.

4. The cutting template as defined in claim 1 wherein:

said means for penetrating meat comprises a row of sharp pointed sawteeth being mounted on said second guide bar.

5. A cutting template to be used for cutting a plurality of meat pieces from a meat section all of which are precisely similar in size and weight, said cutting template comprising:

a rigid member having a vertical plate from which extends a slanted plate, said vertical plate functioning as a guide plate adapted to be placed against an edge of the meat section, an elongated linear bend defining a connection of said vertical member to said slanted plate, said slanted plate being divided into a planar forefinger abutting section and a planar thumb rest section which are separated by an elongated crease, said elongated crease being spaced from said elongated linear bend and extending in the same general direction as said elongated linear bend, said crease being angularly disposed from parallel relative to said elongated linear bend approximately fifteen degrees;

a first corner and a second corner defined on opposite edges of the elongated linear bend;

a guide bar comprising an elongated first leg and a shorter second leg;

the first leg comprising a first end, a second end, and means for penetrating meat there between;

the second leg comprising a first end and a second end; and wherein the first end of the first leg is directly connected to the first corner, the first end of the second leg is directly connected to the second corner, and second ends of both legs are directly connected to one another at an acute angle;

whereby said guide plate is to be placed against a vertical edge of the meat section with the guide bar resting on an upper surface of the meat section with an operator to then move a separate cutting instrument around an exterior edge of the guide bar to cause severing of a meat piece.

* * * * *